United States Patent [19]

Nohira et al.

[11] 3,990,418

[45] Nov. 9, 1976

[54] EXHAUST GAS CONTROL VALVE

[75] Inventors: Hidetaka Nohira; Masaaki Tanaka, both of Susono; Motohisa Miura, Kariya; Zyunziro Yoshimura, Okazaki, all of Japan

[73] Assignees: Nippondenso Co., Ltd., Kariya; Toyota Jidosha Kogyo Kabushiki Kaisha, Tokyo, both of Japan

[22] Filed: Mar. 21, 1974

[21] Appl. No.: 453,534

[30] Foreign Application Priority Data

Mar. 24, 1973 Japan ..... 48-35949[U]

[52] U.S. Cl. ..... 123/119 A; 251/11; 251/60; 251/285

[51] Int. Cl.[2] ..... F02M 25/06

[58] Field of Search ..... 123/119 A; 92/13.1, 92/13.2; 251/60, 285, 11

[56] References Cited

UNITED STATES PATENTS

| | | | |
|---|---|---|---|
| 2,477,897 | 8/1949 | Ray | 92/13.2 |
| 2,532,847 | 12/1950 | Junkin | 251/60 |
| 3,515,368 | 6/1970 | Kelley | 251/11 |
| 3,621,825 | 11/1971 | Ojala | 123/119 A X |
| 3,648,672 | 3/1972 | Muroki et al. | 123/119 A |
| 3,721,421 | 3/1973 | Cliff | 251/11 |
| 3,800,758 | 4/1974 | Sutherland | 123/119 A X |
| 3,812,832 | 5/1974 | Scott | 123/119 A |
| 3,860,169 | 1/1975 | Norman | 251/11 X |
| 3,893,435 | 7/1975 | Konomi et al. | 123/119 A |

*Primary Examiner*—Charles J. Myhre
*Assistant Examiner*—Sheldon Richter
*Attorney, Agent, or Firm*—Cushman, Darby & Cushman

[57] ABSTRACT

An exhaust gas control valve adapted for controlling exhaust gas flow returning to the upstream side of a carburetor from an exhaust line of a vehicle engine. The control valve comprises a means for reducing or stopping the returning exhaust gas when ambient temperature is very low, whereby so called carburetor icing is avoided.

7 Claims, 4 Drawing Figures

EXHAUST GAS CONTROL VALVE

The present invention relates to an exhaust gas controlling valve for controlling the exhaust gas flow returning to the suction part of an engine, which is incorporated in an exhaust gas recirculating system in which the exhaust gas discharged from an internal combustion engine is returned to the suction part of the engine so that the nitrogen oxides contained in the exhaust gas are decreased in amount.

As is well known, in such a recirculating system, the exhaust gas is returned to the engine at a position upstream or downstream of the throttle valve in the suction part of the engine. There has been generally recognized the following technical problem accompanying the above construction.

In case the construction is such that the exhaust gas is returned to a position upstream of the throttle valve, when the temperature of the air sucked through the carbureter decreases to greatly, as is often the case in cold northern districts, the water in the exhaust gas returned to the suction part of the engine freezes about the sliding portions of the throttle valve so that the sliding portions cannot work. This phenomenon is called "carbureter icing".

Even in case the construction is such that the exhaust gas returns to a position downstream of the throttle valve, the water in the exhaust gas is blown back to the carbureter resulting in the same phenomenon if some unusual operating condition such as backfire is established.

The object of the present invention resides in solving the problem described above.

The present invention provides an exhaust gas controlling valve comprising a limiting means associated with the valve in such a manner as to limit the maximum opening of the valve by changing its own position, and a temperature sensing and operating means adapted to displace this limiting means according to the change in the detected temperature in such a manner that the more the detected temperature decreases, the more the maximum opening is reduced.

This temperature sensing and operating mechanism may include wax, and a converting means for converting the change in volume of the wax due to the change in the temperature into a displacement of the limiting member.

Further, the exhaust gas controlling valve in accordance with the present invention may be constructed such that the temperature sensing and operating mechanism includes a chamber having one end thereof opened and a substance filled in the chamber which changes its volume according to the change in the temperature. The limiting means has a piston received in its open end to be slidable in the operating direction of the valve, and the change in volume of the substance displaces the piston.

The exhaust gas controlling valve in accordance with the present invention has the construction described above. When the atmospheric temperature is low, the temperature sensing and operating mechanism acts to decrease the maximum opening of the valve against the effect of the driving means to open the valve. When the temperature further declines to a value extremely low, the maximum opening of the valve is made zero in which state the valve is completely closed, so that the circulation of exhaust gas is stopped. Thus, the problem of icing can be solved in a very satisfactory manner.

The embodiments of the present invention will be explained hereunder with reference to the attached drawings, in which.

Figure 1:
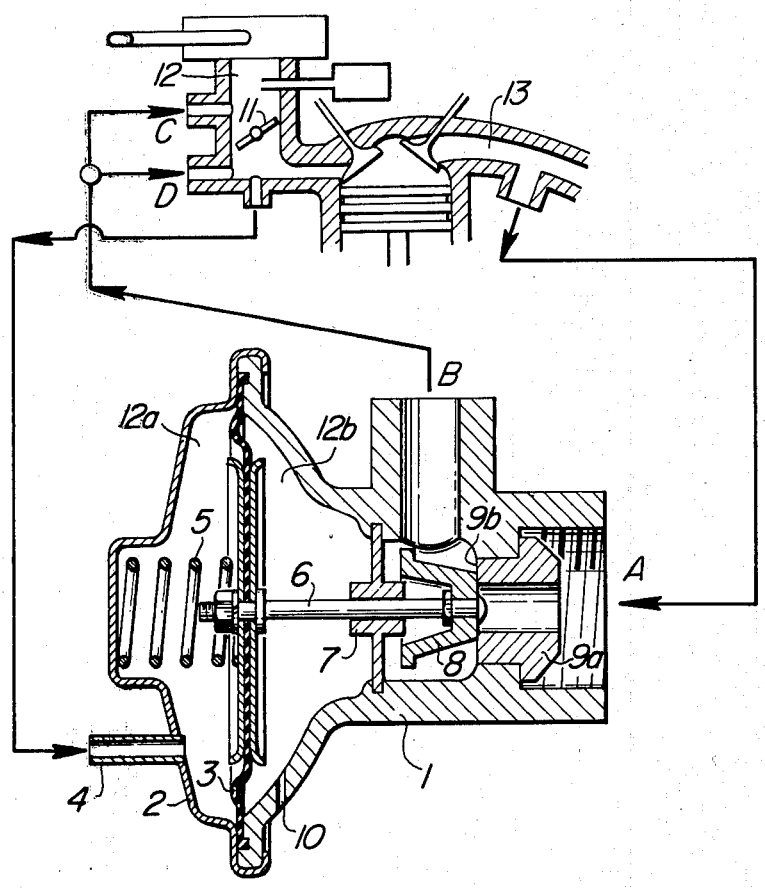
FIG. 1 PRIOR ART
FIG. 1 is a view showing an exhaust gas recirculating device provided with a well known exhaust gas controlling valve according to the prior art.

FIG. 1 shows the construction of a well known type of exhaust gas controlling valve. In FIG. 1, the numerals 1 and 2 indicate respectively a housing and a cover closing one end of the housing 1. The chamber defined by the housing 1 and the cover 2 is divided by a diaphragm 3 into two chambers 12*a* and 12*b*. The cover 2 has a pipe 4 attached thereto, and the negative pressure in the manifold of the engine is present in the pipe 4. A spring 5 is provided between the cover 2 and the diaphragm 3, and a through hole 10 is arranged in the housing 1 so that the chamber 12*b* defined by the housing 1 and the diaphragm 3 is in communication with the atmospheric air. In the operation of the exhaust gas controlling valve having the construction described above, if a negative pressure is applied to the valve intermittently by means of the pipe 4, the diaphragm 3 moves a shaft 6 fixed to the diaphragm 3 horizontally to the left and right as viewed in FIG. 1 overcoming and yielding to the effect of the spring 5. The shaft 6 is supported by a bushing 7 fitted to the housing 1. The exhaust gas flows from an exhaust pipe of engine 13 into the housing 1 as shown by the arrow A in the figure, and when a valve 8 and a valve seat 9*a* are in the open state, flows further into a suction pipe of engine 12 as shown by the arrow B. When the valve 8 and the valve seat 9*a* are brought to the closed state, the exhaust gas stops flowing. As described above, an exhaust gas controlling valve is a valve which opens and closes the passage for exhaust gas by utilizing the application of the negative pressure in the engine to the interior of a diaphragm chamber, or by making use of some other method. In case of the exhaust gas controlling valve with the above construction, the recirculating exhaust gas enters the engine at a position upstream or downstream of a throttle valve 11 as shown in FIG. 1. If the construction is such that the exhaust gas enters the engine at a position upstream of the throttle valve 11, there is a very strong possibility that, when the atmospheric temperature is low, the sliding portions of the throttle valve 11 in the carbureter will freeze due to the water content in the recirculating exhaust gas, which comes around said sliding portions. This phenomenon, commonly called "carbureter icing," offers a serious problem. The possibility of occurrence of such a phenomenon is also strong, even though to a lesser extent, in the construction in which the exhaust gas enters the engine at a position downstream of the throttle valve 11. For instance, when a backfire takes place, the water content in the recirculating exhaust gas is blown from the combustion chamber of engine back to the carbureter resulting in carbureter icing. In the face of the above disadvantage in the conventional constructions, the present invention has as the object thereof the provision of an exhaust gas controlling valve in which, when the atmospheric temperature falls below a predetermined value, a valve 8 is closed using a driving means other than the negative pressure in engine, such as wax, so that the exhaust gas stops recirculating in the engine.

Figure 2:
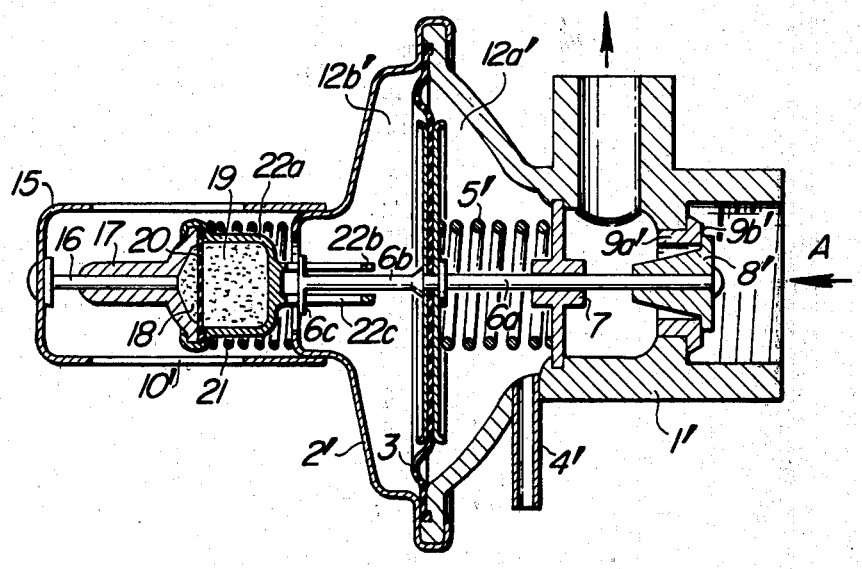
FIG. 2 is a sectional view illustrating a first embodiment of the present invention.
Figure 3:
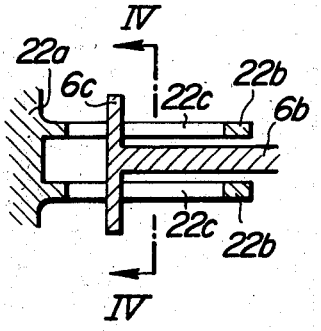
FIG. 3 is an enlarged sectional view showing a part of the device illustrated in FIG. 2.
Figure 4:
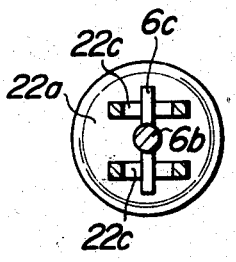
FIG. 4 is a sectional view taken along the line IV—IV of FIG. 3.

The present invention will be explained hereunder with reference to the embodiments thereof shown in the drawings. FIG. 2 illustrates a first embodiment of the present invention, the construction of which is substantially the same as that of the well known exhaust gas controlling valve shown in FIG. 1, except for a projecting portion provided on a cover 2'. In addition to the provision of this projecting portion, the construction of this embodiment differs from the construction of FIG. 1 in that a pipe 4' and a spring 5' are disposed at positions opposite to those taken by the pipe 4 and the spring 5 in the construction of FIG. 1 as viewed from a diaphragm 3 of FIG. 2, and that a valve seat surface 9b' is formed by a surface of a valve seat 9a' opposite to the surface of the valve seat 9a' facing the diaphragm 3. A detailed explanation will now be given on a temperature sensing and driving mechanism mounted in the projecting portion on the cover 2'. The numeral 15 designates a case to which a plunger 16 is fixed, and one end of the case 15 is rigidly secured to the cover 2'. The numerals 18 and 19 indicate masses of wax respectively sealed in a chamber defined by a rubber plate 20 and a plunger supporting case 17, and in a chamber defined by the rubber plate 20 and a wax storing case 22a. The wax mass 19 is a substance having a large coefficient of thermal expansion and its volume is decreased as the temperature lowers. The numeral 21 designates a compression spring disposed between the cover 2' and the wax storing case 22a. A connecting portion arranged between the wax storing case 22a and a shaft 6a has, as shown in FIGS. 3 and 4, a construction that at one end of the wax storing case 22a are provided two hanger plates 22b having elongated slots 22c which receive a pin 6c at the end of a shaft 6b connected directly to the shaft 6a.

The maximum opening of a valve 8' is determined by the engagement of the hanger plates 22b and the pin 6c, as will be explained later. It will be easily understood that, referring to FIG. 2, the nearer the hanger plates 22b are located to the left and of the figure, the more the maximum opening of the valve 8' is reduced. Thus, in this embodiment, the hanger plates 22b constitute a limiting means for limiting the maximum opening of the valve 8'.

An explanation will be made on the operation of the exhaust gas controlling valve in accordance with the present invention, which has the construction described above. When the atmospheric temperature rises to a value above a predetermined value, the wax mass 19 expands according to the change in atmospheric temperature with a resultant swelling of the rubber plate 20 toward the left as viewed in FIG. 2. Due to the effects of the swollen portion of the rubber plate 20 and the increased volume of the wax mass 18, a force is applied to the plunger 16 so that the plunger 16 is pushed out from the housing 17. However, in reality, as the plunger 16 is fixed to the case 15, the wax storing case 22a moves to the right as viewed in FIG. 2 to a position in which the wax storing case 22a is in equilibrium with the effect of the spring 21. Since, as described previously, the wax storing case 22a and the shaft 6b are connected to each other in a loose manner by means of the elongated slots 22c and the pin 6c, the pin 6c merely moves in the elongated slots 22c when the hanger plates 22b are moved to the right as viewed in FIG. 2, so that the expanding force of the wax mass 19 cannot be transmitted to the shaft 6b. Needless to say, the length of the elongated slots 22c is so determined that in accordance with the change in atmospheric temperature there can be fully accomplished a maximum expansion of the wax mass 19, i.e., a maximum displacement of the wax storing case 22a. When the atmospheric temperature decreases to a value less than the predetermined value, the wax mass 19 contacts to produce a force reverse in action and direction to the force produced in the expanding operation of the wax mass 19 with the result that the wax storing case 22a is moved to the left as viewed in FIG. 2. At this time, the pin 6c is hooked by the hanger plates 22b fixed to the wax storing case 22a and moves to the left as viewed in FIG. 2. With this movement of the pin 6c, the shaft 6b also moves to the left as viewed in FIG. 2, so that the valve 8' fixed to the shaft 6b comes into contact with the valve seat surface 9b' of the valve seat 9a'. Thus, in this state, the exhaust gas does not recirculate and cannot be sucked in the suction part of engine. The strength of the spring 21 is so determined that, once closed, the valve 8' does not open for a required period of time even if an abnormally strong negative pressure is applied from the engine to a chamber 12a' through the pipe 4'.

Figure 5:
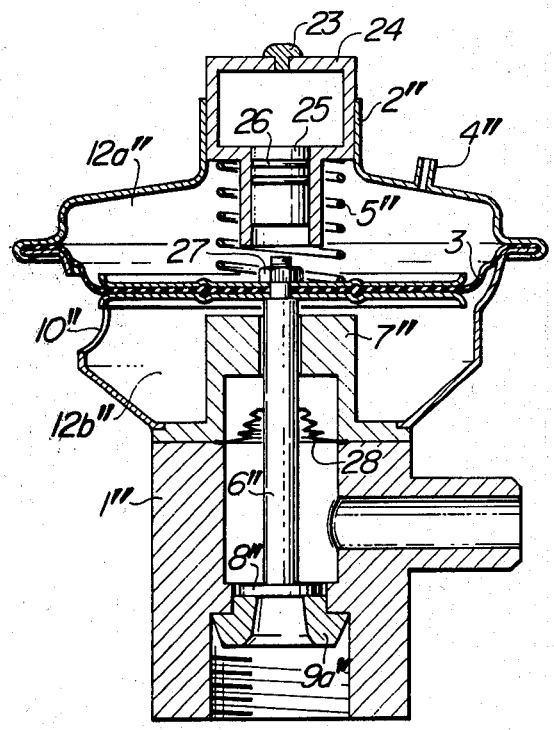
FIG. 5 is a sectional view showing a second embodiment of the present invention.

Next, an explanation will be given on a second embodiment of the present invention. Referring to FIG. 5, the numeral 23 indicates a plug used for pouring a substance into a cylindrical case 24. The lower portion of the case 24 is reduced in diameter and receives a piston 25. Between the inner surface of the case 24 and the piston 25 is provided an O-ring 26 applied with such a lubricant as silicone grease. The temperature sensing and driving mechanism comprises this substance, the plug 23, the case 24, and the O-ring 26, and the piston 25, for limiting the maximum opening of a valve 8''. This temperature sensing and driving mechanism is fixed to a cover 2'' at a position opposite to a shaft 6'', for the purpose of limiting the maximum opening of the valve 8''. The large-diameter portion of the case 24 is welded to the cover 2''. A chamber 12a'' surrounded and defined by the case 24, the piston 25, the cover 2'', and a diaphragm 3 communicates with the outside of the engine through a pipe 4'' alone. A chamber 12b'' disposed adjacent to the chamber 12a'' with the diaphragm 3 placed therebetween, communicates with the atmospheric air by means of a through hole 10. The shaft 6'' is fixed to the diaphragm 3 to be integral therewith by means of nuts 27. The shaft 6'' is centered by a bushing 7'' and has the valve 8'' at its end. The valve 8'' and a valve seat 9a'' fitted to a housing 1 are in surface-to-surface contact. A bellows 28 separates the housing portion including the bush 7'' from the gas passage in the housing 1''.

Figure 6:
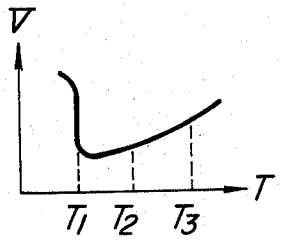
FIG. 6 is a characteristic diagram showing the relationship between the temperature and the volume of water.

An explanation will be made hereunder on the operation of the exhaust gas controlling valve in accordance with the present invention, which has the construction described above. The operation is varied depending upon the kind of substance used in the case 24. Here the case where water is used as such a substance will be explained in detail. As is well known, water has the minimum density when its temperature is around 4° C and transforms into ice when its temperature is 0° C. FIG. 6 shows this relationship. In FIG. 6, volume is plotted along the ordinate V and temperature is plotted along the abscissa T. Water increases in volume when it transforms into ice. Water has a density of 1.00 g/cm$^2$ when its temperature is 0° C while ice at a temperature of 0° C has a density of 0.917. Thus, water increases in volume by about 8 % when it transforms into ice. On the other hand, the water at a temperature of 20° C has a coefficient of expansion of $0.20 \times 10^{-31}$/° C, and the water at a temperature of 100° C has a coefficient of expansion of $0.80 \times 10^{-31}$/° C. Thus, if the temperature of water is raised from 20° C to 100° C, the water increases in volume by about 4 %. Under normal temperature conditions, the piston 25 is located in a position shown in FIG. 5. In this state, if the negative pressure for operating the EGR valve is applied to the diaphragm 3 through the pipe 4'', the exhaust gas controlling valve operates normally. When the temprature becomes below 0° C, the water transforms into ice and increases in volume, so that the piston 25 is pressed downwardly. The downwardly moving piston 25 collides with the head of the shaft 6'' and stops. Once this state is established, the shaft 6'' does not move and the valve 8'' remains closed even if the operating negative pressure is applied to the diaphragm 3 through the pipe 10. When the temperature goes up, the ice transforms into water to restore the piston 25 to the position shown in FIG. 5, so that the valve again performs normal operation. If the temperature rises high and the water boils increasing in volume, the same operation as when the water freezes takes place.

In the above description, the valve is driven by the diaphragm which operates by virtue of the negative pressure produced by the sucking operation of engine, as is commonly done in the operation of the conventional exhaust gas controlling valves. However, the device in accordance with the present invention can be applied to other types of exhaust gas controlling valve in which the valve is driven by other means than the negative pressure in engine, for example by electromagnetic coils, to attain the same valve operation.

As has been described in the foregoing, in accordance with the present invention, the exhaust gas controlling valve having the valve for opening and closing the exhaust gas passage includes the temperature sensing and driving mechanism which expands and contracts detecting the temperature change in the temperature measuring section, the operating range of said valve is limited in such a manner that said valve operates only at low temperatures in response to the expansion and contraction of said temperature sensing and driving mechanism, and said valve is closed when the temperature is low and there is a possibility of carbureter icing so that an outstanding effect of stopping the recirculation of exhaust gas in the engine can be accomplished. Moreover, the exhaust gas controlling valve in accordance with the present invention has an excellent effect that the number of parts used can be decreased because the exhaust gas controlling valve body is provided with a means for detecting the ambient temperature, making unnecessary the wiring and piping which are indispensable for the commonly used temperature detectors. Further, the exhaust gas controlling valve in accordance with the present invention offers a distinguishing effect that the cutting-off force of the valve is sure and strong since the change in volume of a liquid is utilized for producing such a force.

We claim:

1. An exhaust gas controlling system for an internal combustion engine comprising:

a valve housing having an inlet port provided therein adapted to be connected to an exhaust pipe of said engine and an outlet port therein adapted to be connected to a suction pipe of said engine;

valve means including a valve body and a valve seat mounted in said valve housing for communicating said inlet port with said outlet port therethrough when opened;

a diaphragm dividing said housing into first and second chambers, said first chamber being adapted for connection to the atmosphere and said second chamber being adapted for connection to said suction pipe of said engine;

a first shaft fixed at one end thereof to said valve body and at the other end to said diaphragm for axial movement with said diaphragm whereby a force is applied to said valve means to cause said valve means to open when negative pressure is applied to said second chamber from said suction pipe of said engine; and said diaphragm and shaft are axially displaced in response thereto, the axial displacement of said shaft determining the amount of exhaust gases passing through said housing; and means responsive to changes in ambient temperature for decreasing the axial range of movement of said diaphragm and said first shaft as the ambient temperature decreases in order to decrease the amount of exhausted gas flowing through said valve means.

2. A system as in claim 1 wherein said decreasing means includes a second shaft fixedly attached to said diaphragm and extending in said first chamber away from said diaphragm, thermal actuating means mounted for displacement with respect to said second shaft as a function of temperature, and means connected to said thermal actuating means for movement therewith and engaging said second shaft for permitting limited movement of said second shaft and said diaphragm with respect to said engaging means.

3. A system as in claim 2 wherein said second shaft ends in a pin and wherein said engaging means includes a pair of hooking plates with slots therein for engaging said pin.

4. A system as in claim 3 wherein said thermal actuating means includes a wax housing attached to said plates and a quantity of wax therein of the type which changes volume in response to temperature changes.

5. A system as in claim 4 wherein said thermal actuating means further includes an actuating casing, a plunger fixed at one end to said casing and extending into said wax housing, means for mounting said casing to said valve housing, a spring urging said wax housing away from said valve housing so that expansion of said wax causes said wax housing to displace against said spring and said second shaft to move therewith.

6. A system as in claim 1 wherein said thermal actuating means includes a thermal case mounted within said second chamber, an expansion substance within said thermal case, a piston mounted for movement toward and away from said diaphragm as a function of the volume of said substance.

7. A system as in claim 6 wherein said substance is water.

* * * * *